United States Patent [19]

Kwan et al.

[11] 4,179,223

[45] Dec. 18, 1979

[54] PRINTER CENTER SENSING MECHANISM

[75] Inventors: Okun Kwan, Trumbull; Nicholas Zaccagnino, Stamford, both of Conn.

[73] Assignee: Bunker Ramo Corporation, Oak Brook, Ill.

[21] Appl. No.: 835,559

[22] Filed: Sep. 22, 1977

Related U.S. Application Data

[63] Continuation of Ser. No. 702,279, Jul. 2, 1976, abandoned.

[51] Int. Cl.[2] ..... B41J 19/14; B41J 19/78; B41J 21/00; B41J 21/08

[52] U.S. Cl. ..... 400/320; 178/26 R; 235/432; 318/282; 400/124; 400/279; 400/323

[58] Field of Search ..... 197/1 R, 82, 84 R, 63, 197/60, 66, 187, 84 A, 19, 65, 18, 53, DIG. 10, 176; 235/61.9 R, 432; 178/23, 26; 318/282

[56] References Cited

U.S. PATENT DOCUMENTS

| | | | |
|---|---|---|---|
| 2,746,304 | 5/1956 | Kuhlmann | 197/DIG. 10 |
| 3,060,846 | 10/1962 | Sommer et al. | 235/432 |
| 3,167,166 | 1/1965 | Schiebeler | 197/1 R |
| 3,242,317 | 3/1966 | Reiss et al. | 235/432 |
| 3,443,186 | 5/1969 | Martin | 318/282 |
| 3,519,118 | 7/1970 | Reszka | 197/82 |
| 3,559,792 | 2/1971 | Guldenpfennig | 197/187 |
| 3,578,129 | 5/1971 | Kato et al. | 197/176 |
| 3,578,131 | 5/1971 | Heidt et al. | 197/82 |
| 3,838,250 | 9/1974 | Naas et al. | 235/61.9 R |
| 3,858,702 | 1/1975 | Azuma | 197/1 R |
| 3,882,988 | 5/1975 | Sloan et al. | 197/82 |
| 3,905,463 | 9/1975 | Boyce et al. | 197/1 R |
| 3,951,251 | 4/1976 | Zaccagnino | 197/1 R |
| 3,970,183 | 7/1976 | Robinson et al. | 197/1 R |
| 4,026,402 | 5/1977 | Byrd | 197/176 |
| 4,031,996 | 6/1977 | Busch | 197/176 |
| 4,044,882 | 8/1977 | Weinke et al. | 197/82 |

*Primary Examiner*—Clyde I. Coughenour
*Attorney, Agent, or Firm*—F. M. Arbuckle; M. Liss

[57] ABSTRACT

Three fixed optical sensing devices are positioned to sense the left and right margins as well as the center location of high speed printer carriage travel. Signals from the sensing devices are fed to programmed carriage logic control circuits which effect rapid carriage movements relative to the center location as well as the traditional left and right margin locations. Printing time of certain forms is greatly reduced by minimizing unnecessary carriage return to the left margin location.

19 Claims, 5 Drawing Figures

PRINTER CENTER SENSING MECHANISM

This is a continuation, of application Ser. No. 702,279, filed July 2, 1976, now abandoned.

FIELD OF THE INVENTION

The present invention relates to an improved mechanism for driving the print head carriage of a high speed printer and more particularly to a mechanism for bidirectionally driving the carriage relative to a center position of carriage displacement.

BACKGROUND OF THE INVENTION

In most contemporary high speed printers a carriage mounts a printing head, often of the wire matrix type, and printing occurs as the carriage is moved across a line of a document. Existing printers print on the fly and each time a line of print is completed, the carriage returns to the customary left margin or home position. Generally, sensors are located at the left margin and right margin positions so that the end of a line is sensed which causes the return of the carriage to the left margin or home position. Such a prior art mechanism is disclosed in U.S. Pat. No. 3,882,988 to Sloan et al.

In the printing of certain forms, it is customary for information to be printed on the right or left portion of a document, with respect to a center line through the document, instead of a complete line across the width of the document. If a number of different lines are to be printed this way, a loss of time would be incurred when the carriage travels the entire distance between the left margin and right margin. Accordingly, it would be of great advantage if a mechanism could be installed on high speed printers which would sense the center location and begin a print operation relative to the center location. As an example of the utility for the present invention, reference is made to customary car rental forms which generally have information printed across an entire line of the form on certain portions of the document while on other portions of the document line after line is printed between the document center and the margins. In repetitive printing operations of car rental forms for waiting customers, the increased speed of document completion is advantageous. Of course, the utilization of the present invention in connection with car rental forms is merely illustrative and pertains to the printing of forms and documents, generally.

SUMMARY OF THE INVENTION

The present invention utilizes left and right margin sensors as in the case of the prior art as described in the aforementioned patent. In addition, a sync. track is employed, as described in the mentioned patent, to locate the printer carriage at adjacent character stroke positions during the actual printing operation. In addition, a third or center optical sensor is employed to detect the passage of a printer carriage across the vertical center of a document so that the printer, as programmed, may quickly establish the printing operation at the center as opposed to requiring a return of the carriage to the traditional left margin position. As a result of the present invention, the total time required for printing of certain forms is greatly reduced and the reliability of the printer is increased by minimizing the mechanical motion of the carriage over a period of operational useage.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
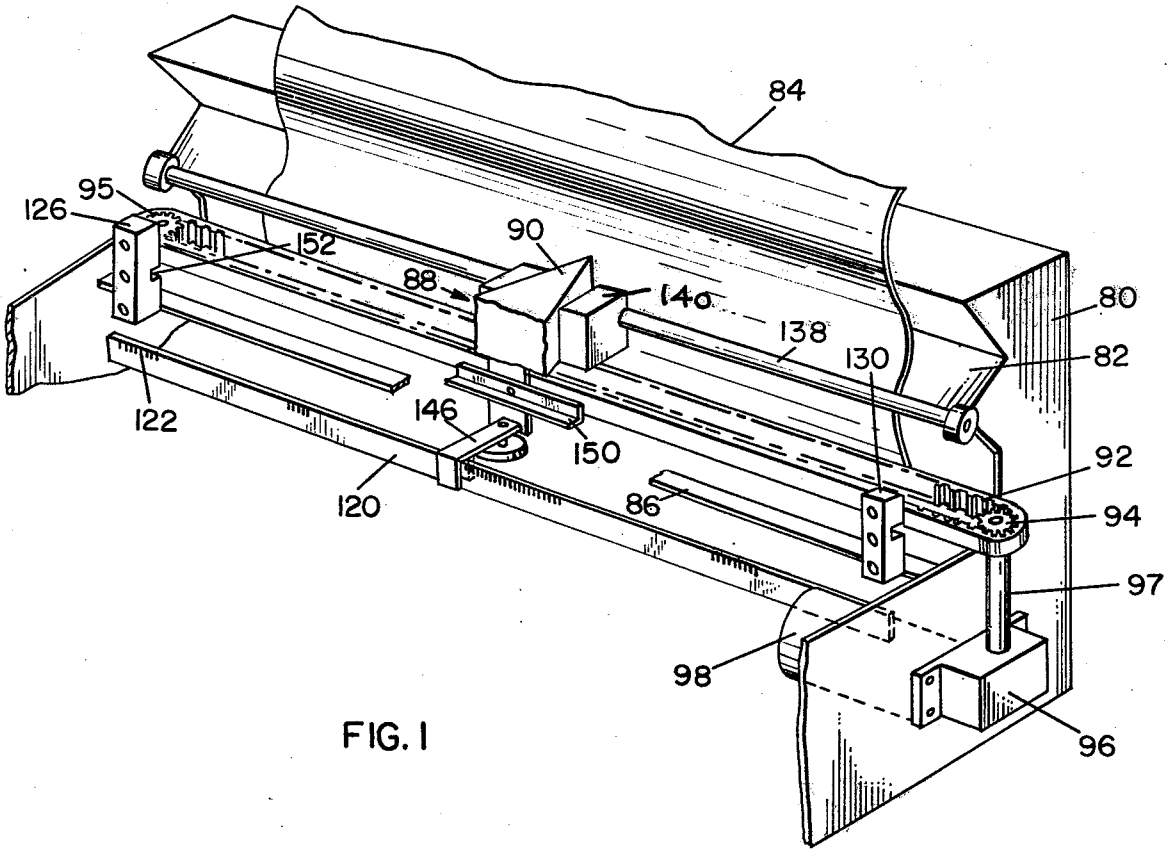
PRIOR ART FIG. 1
FIG. 1 is a partial perspective view of a printer that constitutes the most relevant known prior art.

Referring to the figures and more particularly FIG. 1 thereof, a perspective view of the most relevant prior art is illustrated. The printer mechanism illustrated in this figure is the mechanism illustrated and disclosed in the previously mentioned U.S. Pat. No. 3,882,988. The printer illustrated in FIG. 1 includes a housing 80 having a platen 82 supporting a document 84 on which printing is to be performed. In front of the platen 82 is a rail 138 and there is also a rail 86 mounted on the housing. A print head assembly 88 is journalled to move along rails 138 and 86. The print head assembly 88 includes a print head 90, a carriage 140 and a shutter 150 projecting from the carriage 140. The function of the shutter will be described later.

A toothed belt 92 of rubber or similar material passes through and is secured to carriage 140. Belt 92 passes over idler roller 95 at the left end of the housing and over a drive roller 94 at the right end of the housing. Roller 94 is connected through a shaft 97 and a gear box 96 to a motor 98. In the embodiment described in the aforementioned patent, motor 98 is a brushless DC motor which runs at a multiple of the rate at which roller 94 is rotated in order to move the assembly 88 from one end of rails 138 and 86 to the other, across a print line. Mounted at the left and right margins or near each end of rail 86 is a detector housing. The left detector housing is indicated by reference numeral 126 while the right housing is indicated by 130. Each of the housings contains a light emitter and a light detector separated by a gap 152. The relative positions of the housings 126, 130 and the shutter 150 are such that, when assembly 88 moves adjacent one of the housings 126, 130, the shutter 150 moves into the gap 152 thereby interrupting light passage between the light emitter and photocell of each housing which causes a predetermined change in the photocell output. This is the means for detecting the arrival of the print head assembly 88 to the left or right margin.

A synchronization (sync.) track 120 is mounted on the housing. The track is a clear plastic or glass member having gratings or sync. line markings 122 inscribed along the length of the track. A single sync. marking corresponds with each stroke position at which printing may occur. The head assembly 88 includes an inverted U-shaped member 146 having an arm on each side of the track 120. In one arm of the member 146 is mounted a light source and in the other arm is mounted a photocell. The manner in which the sync. track is utilized to control printing and other aspects of the actual printing operation do not form part of the present invention and will therefore not be described further herein. A more detailed description of the operation of a printer of the general type shown in FIG. 1 may be found in U.S. Pat. No. 3,703,949 to Howard, et al.

Figure 5:
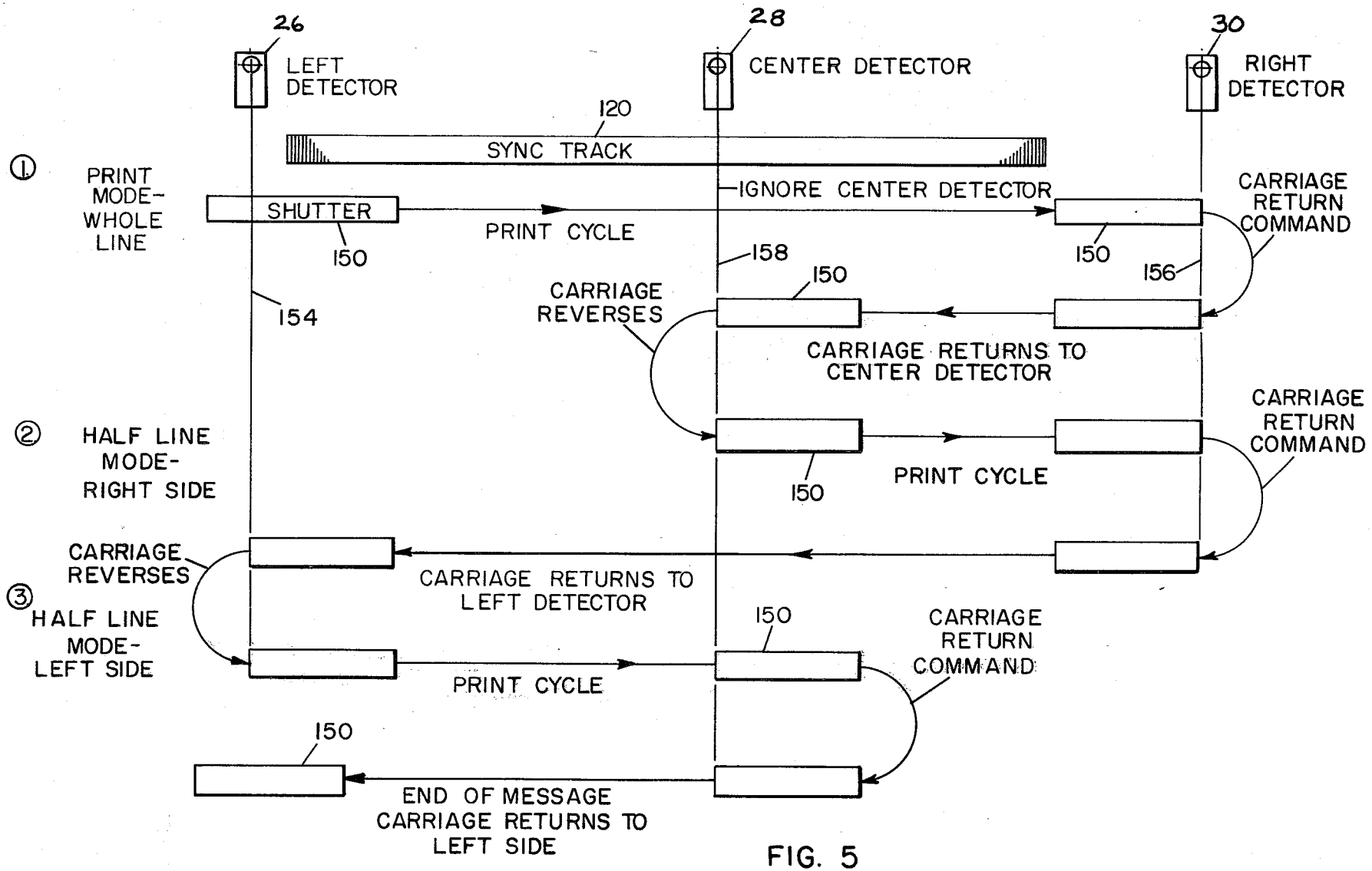
FIG. 5 is a schematic representation of the three basic modes of printer carriage motion relative to the center.

Regarding the present invention, FIG. 5 is a schematic representation of the three basic modes of printer carriage motion relative to the center. As will be shown in greater detail hereinafter, the left and right detectors 26 and 30 appear in the present invention in addition to a center detector 28 of similar design as the other detectors. The center detector 28 is positioned approximately mid-way between the left and the right detectors. However, for particular forms which have a wider left side than right side, the center detector may be appropriately repositioned. In a first mode of operation, indicated as the PRINT MODE-WHOLE LINE, the shutter 150 of the present invention is seen to assume a position whereby the left edge thereof is in the left margin 154. If an entire line is to be printed in accordance with the program for the printing of a particular form, the carriage will travel across the sync. track 120 and the center detector 28 will be ignored. Finally, when the shutter 150 has its right edge detected by the right detector 30, an entire line has been printed. A carriage return command may then cause the carriage to move from the right margin 156 to the center where the shutter 150 has its left edge detected by the center detector 28. If the printer is programmed appropriately, the carriage will stop at the center margin line 158 and the carriage reversal will be initiated so that a print cycle can take place on the right side of a form as shown. This is indicated as a HALF LINE MODE-RIGHT SIDE. A customary carriage return command results in the carriage returning to the left margin, ignoring the center detector. Then it is possible to begin a third mode of operation indicated as the HALF LINE MODE-LEFT SIDE. During this mode of operation, the carriage and attached shutter move across the sync. track 120 until the left edge of the shutter is detected by the center detector 28. At this point, the left side of the form will be printed and a carriage return command may be initiated so that the carriage and the shutter 150 may be returned to the left side for the initiation of additional print cycles.

Figure 2:
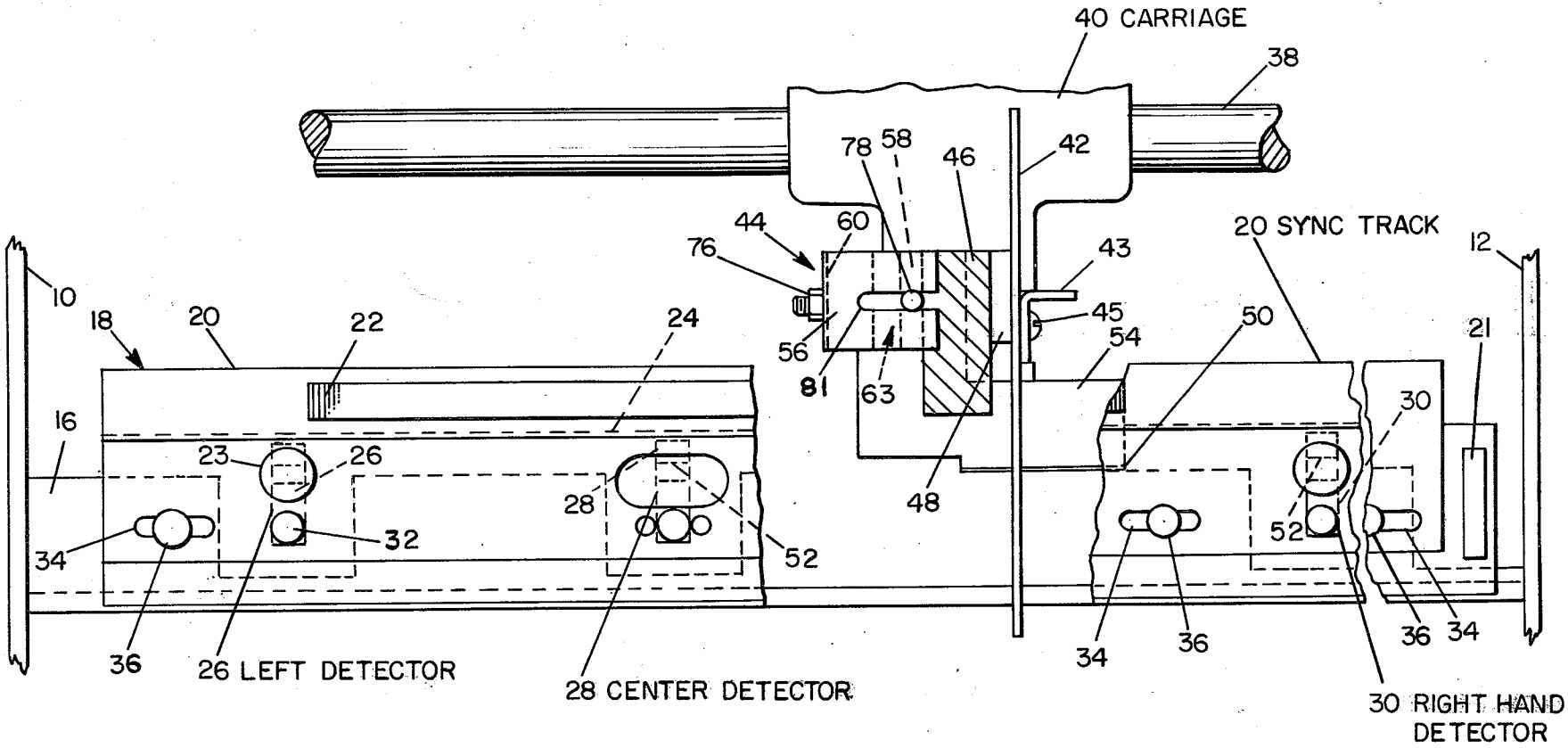
FIG. 2 is a cut-away front elevational view of the present mechanism.
Figure 3:
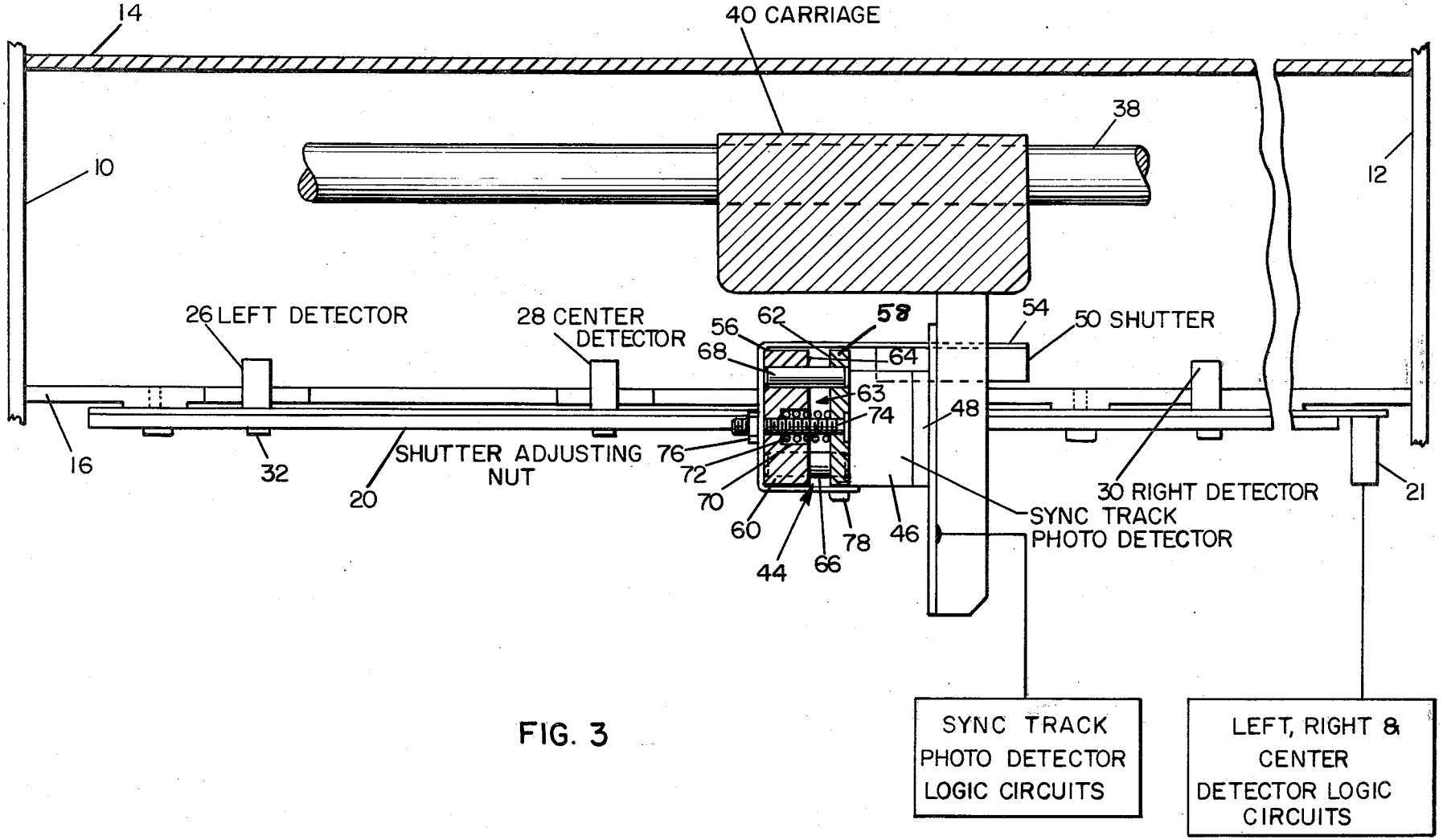
FIG. 3 is a top plan view of the present mechanism.

Referring to FIGS. 2 and 3, the mechanical components constituting the present invention will be seen. The invention is an improvement of the mechanism shown in FIG. 1 and is made possible, primarily, due to the addition of a center detector 28 between the left and right detectors 26 and 30.

The frame portion of a printer is seen to include side walls 10 and 12 as well as a shelf plate 14. A vertical bracket 16 mounts an elongated assembly 18 which is comprised of the sync. track 20 corresponding to an identical component 120, referenced in connection with the prior art FIG. 1. Sync. track markings 22 are inscribed as were the markings 122 previously discussed in connection with FIG. 1. In order to minimize wiring connected to the detectors, an elongated printed circuit board 24 is appropriately fastened to the back of the sync. track 20. Electrical termination to the printed circuit board is provided through a printed circuit board connector 21. Openings such as 23 are formed in the sync. track so that soldering connections may be made between the printed circuit board and the detectors. Each of the dectectors is appropriately fastened to the printed circuit board by means of a suitable fastener 32. The assembly 18 includes a number of oblong slots 34 for receiving fasteners 36 that adjustably connect the assembly 18 to the bracket 16.

A rail 38 extends between the side walls 10 and 12 and as in the case of the printer of FIG. 1, this rail mounts a printer head carriage 40 (printer head not shown). A bracket 43 is appropriately fastened to the carriage 40 and the bracket mounts a printed circuit board 42 which includes electrical components for controlling a generally U-shaped detector 46 which picks up the sync. track markings in the same manner as member 146 in FIG. 1. The relationship between the detector 46 and the sync. track 20 may better be appreciated by referring to FIG. 4. As shown in FIG. 2, the sync. track dectector 46 is separated from the printed circuit board 42 by an insulator block 48.

Figure 4:
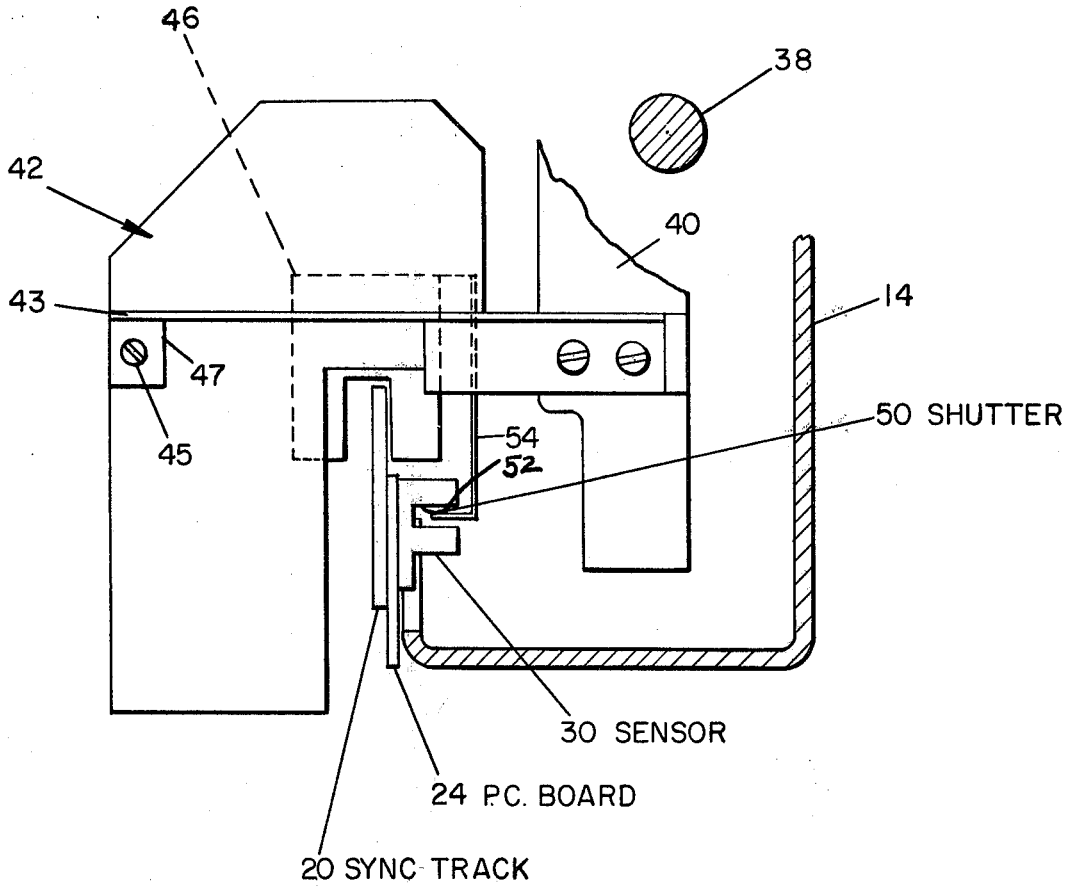
FIG. 4 is a side elevational view of the present mechanism.

The bracket 43 which is fixedly mounted to the carriage 40 has a shutter 50 perpendicularly mounted to the bracket 43 as shown in FIGS. 2 through 4. The shutter 50 operates in the same manner as the shutter 150 described in connection with FIG. 1 of the prior art. That is, the shutter 50 cooperates with the left detector 26, center detector 28 and right detector 30 for sensing the movement of the carriage to the respective locations of these detectors. As clearly shown in FIG. 4, the horizontal flange portion of the shutter 50 passes through the gap 52 formed in each detector housing for the left detector 26, center detector 28 and right detector 30. These detectors are commercially available and may be of the type manufactured by General Electric and denoted by Model No. H13B1. Typically, this type of detector has a light emitting diode located on one side of the gap while a phototransistor is located on the opposite side of the gap so that when the shutter 50 passes through the gap, light transfer from the light-emitting diode to the phototransistor is interrupted and a pulse signal is generated therefrom. The shutter 50 has a vertical flange portion 54 (FIGS. 3 and 4) which is integrally formed with a bracket 56 that encloses an adjustable shutter mechanism or assembly 44. The purpose of this assembly is to permit an adjustable relationship between the edges of the shutter 50 and a particular marking for the center of the sync. track markings 22.

Referring to FIG. 3, the components of the adjustable shutter assembly 44 are shown in cross sectional detail. A first block 58 is maintained in adjustable spaced relationship with the block 60, both of these blocks being located within the bracket 56 and having confronting faces 62 and 64. Guide pins 66 and 68 are positioned within and between the blocks 58 and 60 to maintain the confronting faces 62 and 64 in parallel relationship. Recess 70 is formed within the larger block 60 to accommodate the first end of a spring 72. The opposite end of the spring bears against the face 62 of block 58. The purpose of the spring is to bias the blocks 58 and 60 outwardly from one another. A pin 74 is mounted through the recess 70 and is anchored within block 58. The pin passes through the bracket 56 and has an adjusting nut 76 mounted outwardly of the bracket 56. In order to change the width of the gap 63 between the blocks 58 and 60, all that is required is for an adjustment to be made of the nut 76. The block 58 is appropriately secured to the U-shaped photodetector 46 so that the block 58 remains stationary with respect to the carriage 40. However, the shutter 50, which is integrally formed with the bracket 56 is secured to the block 60 and is movable therewith. By adjusting the nut 76, the shutter 50 is made to move relative to the carriage 40 and is also movable with respect to a center marking on the sync.

track 20. The printer is set up by adjusting the nut 76 appropriately so that the edges of shutter 50 align themselves with preselected sync. track markings. This is required so that when the carriage is programmed to return to the center position of a document, the edge of shutter 50 will seek a preselected sync. track marking, precisely. As a result, there will be exact registry between print characters one line beneath the next. After an adjustment of nut 76 has been made, the slot 81 (FIG. 2) will assume a particular disposition with respect to the lock fastener 78. The lock fastener 78 is tightened so that the position of bracket 56 may be maintained.

FIG. 3 depicts a block labeled SYNC TRACK PHOTO DETECTOR LOGIC CKTS. These conventional circuits do not form a part of the present invention, per se, but are necessary to power and process detected signals from the sync. track photodetector. The printed circuit board 42 would normally include conventional wave shaping and amplifying circuits for the output signals from the sync. track photodetectors. Also, a block is included in FIG. 3 which is labeled LEFT, RIGHT AND CENTER DETECTOR LOGIC CKTS. This block would include conventional logic circuits, which do not form a part of the present invention, per se, for driving and processing information from the left, right and center detectors 26, 28 and 30. The aforementioned U.S. Pat. No. 3,882,988 discloses circuitry which utilizes detected signals from detectors as used in the present invention for positioning the printer carriage as a form is printed.

As will be appreciated from the above description of the invention, an improved printer mechanism is achieved which minimizes the printing time of certain documents due to the inclusion of a center detector. Further, by adjustably mounting the shutter 50 relative to the carriage 40, character alignment between successive lines may be achieved relative to a center margin.

It should be understood that the invention is not limited to the exact details of construction shown and described herein for obvious modifications will occur to persons skilled in the art.

We claim the following:

1. Apparatus for controlling starting and stopping points of a line of print on a document in a printer mechanism, comprising:

(a) a printer carriage traveling between right and left margin positions relative to the document, (b) margin sensors for detecting arrival of said printer carriage at said right and left margin positions, (c) a stationary frame for mounting said printer mechanism thereon, (d) intermediate photodetecting means stationarily mounted relative to said frame intermediate said margin senors for bidirectionally detecting arrival of said printer carriage at a preselected intermediate position located between said left and right margins, (e) shutter means mounted on said printer carriage for movement therewith, said shutter means being detected by said margin sensors and by said intermediate photodetecting means in both directions of motion of the carriage passing the intermediate position from either right or left margin positions, (f) logic control circuits coordinating signals from said left and right margin sensors and from said intermediate detecting means for selective elimination of full travel by said printer carriage on one or another side of said preselected intermediate position by providing at least one additional optional starting and stopping point for said line of print intermediate said left and right margin positions, and (g) means connected to said intermediate detecting means for feeding a detection signal therefrom to said logic control circuits, (h) whereby said new line of print is positioned relative to said preselected intermediate position.

2. The subject matter set forth in claim 1 together with stationary track means mounted to the frame, the track means having markings thereon corresponding with printer stroke locations, and track photodetecting means mounted to the carriage for detecting the location of the markings as the carriage scans the track means.

3. The subject matter set forth in claim 1 together with means for adjustably mounting the track photodetecting means to the carriage for aligning the track photodetecting means with a particular marking while the shutter means becomes detected by the photodetecting means.

4. The subject matter set forth in claim 1 wherein the photodecting means comprises:

a housing having first and second portions separated by a gap;

a light emitting diode located in the first portion; and a phototransistor located in the second portion;

the passage of the shutter means through the gap interrupting light passage from the light emitting diode to the phototransistor thus generating a signal from the phototransistor.

5. In a printer mechanism, a center sensing system comprising:

a frame for supporting components of the mechanism;

a movable carriage for supporting a printer head;

means mounted to the frame for guiding the motion of the carriage;

left, right and intermediately disposed photodetecting means mounted in colinear spaced relationship to each other, and stationary with respect to the frame;

shutter means mounted to the carriage for movement therewith, the shutter means detected by the respective photodetecting means when the carriage passes by corresponding left, right and intermediate margins of a document being printed by the printer head; and means connected to the left, right and intermediate photodetecting means for feeding detection signals therefrom to logic control circuits for selective elimination of full travel by said carriage on one or another side of said intermediate margin position by providing at least one additional optional starting and stopping point for a line of print intermediate said left and right margin positions.

6. The subject matter set forth in claim 5 together with stationary track means mounted to the frame, the track means having markings thereon corresponding with printer stroke locations, and track photodetecting means mounted to the carriage for detecting the location of the markings as the carriage scans the track means.

7. The subject matter set forth in claim 6 together with means for adjustably mounting the track photodetecting means to the carriage for aligning the track photodetecting means with a particular marking while the shutter means becomes detected by the intermediate photodetecting means.

8. The subject matter set forth in claim 6 wherein at least one of the photodetectors comprises:

a housing having first and second portions separated by a gap;

a light emitting diode located in the first portion; and a phototransistor located in the second portion;

the passage of the shutter means through the gap interrupting light passage from the light emitting diode to the phototransistor thus generating a signal from the phototransistor.

9. The subject matter set forth in claim 8 wherein the track photodetecting means comprises:

a housing having first and second portions separated by a gap;

a light emitting diode located in the first portion; and a phototransistor located in the second portion;

the shutter means in the gap scanning the track means as the carriage moves, light passage across the gap being interrupted as markings on the track means are located in the gap; and means connected to the track photodetecting means for feeding signals generated by the phototransistor, in response to marking interruptions, to logic circuits for producing printed characters at precise print stroke locations corresponding with the markings.

10. The subject matter set forth in claim 9 together with a printed circuit board mounted to the frame for mechanically mounting the photodetectors thereon, the board having printed circuits thereon for connecting each of said detectors to the logic circuits for governing the programmed starting point of a printed line relative to the left, right or intermediate margins.

11. An apparatus for controlling starting and stopping points of a line of print on a document in a printer mechanism, comprising:

(a) a printer carriage traveling between right and left margin positions relative to the document;

(b) margin sensors for detecting arrival of said printer carriage on said right and left margin positions;

(c) a stationary frame for mounting said printer mechanism thereon;

(d) intermediate detecting means stationarily mounted relative to said frame intermediate said margin sensors for bidirectionally detecting arrival of said printer carriage at a preselected intermediate position located between said left and right margins;

(e) obstructing means mounted on said printer carriage for movement therewith, said obstructing means being detected by the margin sensors and by said intermediate detecting means in both directions of motion of the carriage passing the intermediate position from either right or left margin positions;

(f) logic control circuits coordinating signals from said left and right margin sensors and from said intermediate detecting means for selective elimination of full travel by said printer carriage on one or another side of said preselected intermediate position by providing at least one additional optional starting and stopping point for said line of print intermediate said left and right margin positions;

(g) means connected to said intermediate detecting means for feeding the detection signal therefrom to the logic control circuits;

(h) whereby said new line of print is positioned relative to said intermediate position.

12. The subject matter set forth in claim 11 together with stationary track means mounted to the frame, the track means having indicia thereon corresponding with printer stroke locations, and track detecting means mounted to the carriage for detecting the location of the indicia as the carriage scans the track means.

13. The subject matter set forth in claim 11 together with means for adjustably mounting the track detecting means to the carriage for aligning the track detecting means with a particular indicium while the obstructing means becomes detected by the detecting means.

14. In a printer mechanism, a center sensing system comprising:

a frame for supporting components of the mechanism;

a movable carriage for supporting a printer head;

means mounted to the frame for guiding the motion of the carriage;

left, right and intermediately disposed detecting means mounted in colinear spaced relationship to each other, and stationary with respect to the frame;

obstructing means mounted to the carriage for movement therewith, the obstructing means detected by the respective detecting means when the carriage passes by corresponding left, right and intermediate margins of a document being printed by the printer head; and means connected to the left, right and intermediate detecting means for feeding detection signals therefrom to logic control circuits for selective elimination of full travel by said carriage on one or another side of said intermediate margin position by providing at least one additional optional starting and stopping point for a line of print intermediate said left and right margin positions.

15. The subject matter set forth in claim 14 together with stationary track means mounted to the frame, the track means having indicia thereon corresponding to printer stroke locations, and track detecting means mounted to the carriage for detecting the location of said indicia as the carriage scans the track means.

16. The subject matter set forth in claim 15 together with means for adjustably mounting said track detecting means to the carriage for aligning said track detecting means with a particular indicium while the obstructing means becomes detected by the intermediate detecting means.

17. The subject matter set forth in claim 15 wherein said obstructing means comprises a shutter means, and at least one of said detectors comprises:

a housing having first and second portions separated by a gap;

a light emitting diode located in the first portion; and a phototransistor located in the second portion;

the passage of the obstructing means through the gap interrupting light passage from the light emitting diode to the phototransistor thus generating a signal from the phototransistor.

18. The subject matter set forth in claim 17 wherein the track detecting means comprises:

a housing having first and second portions separated by a gap;

a light emitting diode located in the first portion; and a phototransistor located in the second portion;

the gap scanning the track means as the carriage moves, light passage across the gap being interrupted as indicia on the track means are located in the gap; and means connected to the track detecting means for feeding signals generated by the phototransistor, in response to marking interruptions, to logic circuits for producing printed characters at precise print stroke locations corresponding with the markings.

19. The subject matter set forth in claim 18 together with a printed circuit board mounted to the frame for mechanically mounting the detectors thereon, the board having printed circuits thereon for connecting each of said detectors to the logic circuits for governing the programmed starting point of a printed line relative to the left, right or intermediate margins.

* * * * *